United States Patent [19]

Hutson et al.

[11] 4,190,346

[45] Feb. 26, 1980

[54] AUTOMATED CLEAN-OUT SYSTEM FOR FILM PROCESSORS

[76] Inventors: John W. Hutson, 10250 Warner Ave. #H, Fountain Valley, Calif. 92708; Robert L. Neal, 16911 Sims St. Apt. B, Huntington Beach, Calif. 92649

[21] Appl. No.: 966,084

[22] Filed: Dec. 4, 1978

[51] Int. Cl.[2] ..... G03D 3/02

[52] U.S. Cl. ..... 354/324; 354/333; 137/240; 134/58 R; 134/169 R

[58] Field of Search ..... 354/297, 307, 323, 324, 354/331, 333; 137/240; 134/57 R, 58 RX, 104, 166 R, 169 RX, 171, 22 R

[56] References Cited

U.S. PATENT DOCUMENTS

| | | | |
|---|---|---|---|
| 3,183,820 | 5/1965 | Edgcomb et al. | 134/169 R |
| 3,589,378 | 6/1971 | Swanson et al. | 134/58 R |
| 3,670,744 | 6/1972 | Bender | 134/57 R |
| 3,733,994 | 5/1973 | Armstrong et al. | 354/324 |
| 3,841,351 | 10/1974 | Shida | 354/324 |

*Primary Examiner*—Donald A. Griffin
*Assistant Examiner*—Alan Mathews
*Attorney, Agent, or Firm*—I. Michael Bak-Boychuk

[57] ABSTRACT

Disclosed herein is an automated system adapted to be connected to commercial film processors, the system including a common automated sequencer for advancing the wash, rinsing and fill cycles in both the developer and fixer containers. To accommodate the level requirements in the various containers and the variations in pumping rate there are periodic wait logic sections which bring the developer and fixer cycle into synchronism. The foregoing system includes an interface panel provided with level detectors and the necessary interconnections with the commercial units.

7 Claims, 4 Drawing Figures

AUTOMATED CLEAN-OUT SYSTEM FOR FILM PROCESSORS

BACKGROUND OF THE INVENTION

1. Field of the Invention

The present invention relates to clean-out systems for film processors, and more particularly to automated sequencers for cleaning both the developer and fixer in synchronism.

DESCRIPTION OF THE PRIOR ART

Heretofore the cleaning out and replenishing of film developer and fixer containers and film transport systems has been done most frequently by manual labor. Because of the inherent lack of precision and variations entailed such as lengthy time involved in manual labor, such techniques have led to frequent contamination of the developing fluids with the result that the eventual processed film would lose fidelity. In applications where fidelity is of utmost importance, i.e., applications including the processing of X-ray films, the requirements of cleanliness and precision are paramount, entailing extensive labor costs and elaborate procedures.

SUMMARY OF THE INVENTION

Accordingly it is the general purpose and object of the present invention to provide an automated clean-out system for film processors adapted to operate in various modes.

Yet other objects of the invention are to provide an automated clean-out system for film processors wherein provisions are made for automatic prevention of contamination.

Yet further objects of the invention are to provide a clean-out system which is adaptable to various commercially available film processing devices.

Briefly these and other objects are accomplished within the present invention by providing two parallel hydraulic systems: one tied by way of quick disconnect to the recirculating loop around the developer tank while the other being tied in a similar manner to the fixer tank of a conventional film processor. Included in each system is a holding tank, a circulating pump, and a cleaning fluid container, each of those devices being connected by selectable valving to form either a closed loop or to form a drain-out path for the processing containers.

Both of the foregoing hydraulic systems are driven by a common logical system which includes timing overrides responsive to level detectors in the developer and fixer tanks.

All of the foregoing devices are collected in an interface panel which by virtue of its structure renders this clean-out system portable and adaptable to various commercial applications.

DESCRIPTION OF THE SPECIFIC EMBODIMENT

The present system is directed to cleaning out both the developer and fixer tanks of a photographic developing device. Since the developing and fixing fluids are typically not compatible, two separate fluid paths are entailed each operating in identical manner. For that reason only one half of the fluid path is illustrated in detail; it being understood that the developer or fixer paths are necessarily identical, having the same cleaning functions in each of the processing containers.

Figure 1:
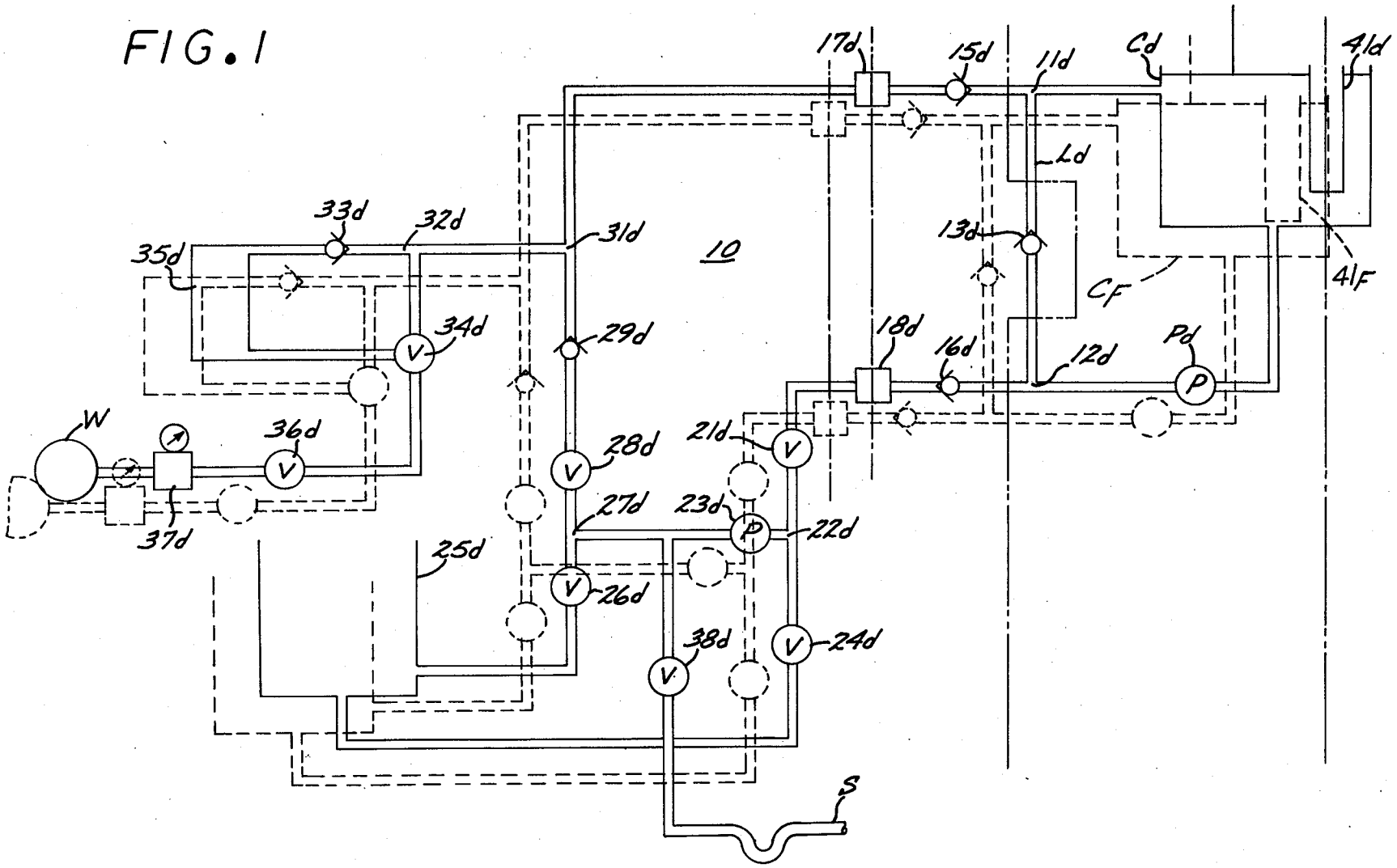
FIG. 1 is a piping diagram illustrating one branch of the clean-out system disclosed herein.

As shown in FIG. 1 a developer container $C_d$, as normally used in the prior art, includes a recirculating pump $P_d$ connected between the bottom of the container and the top by way of a recirculating loop $L_d$. In this form the developer tank or container $C_d$, when the film is processed therein, is continually circulated with the fluids contained to maintain an even chemical distribution. It is to be understood that the fixer tank shown as $C_f$ is similarly implemented with its own circulating pump $P_f$ and circulating loop $L_f$. Typically both the developer tank and the fixer tank were flushed out by fresh water, filters were changed, and other clean-out procedures were engaged in on a periodic basis. The spent developing fluid is either drained into a waste line or returned for collection to recover the constituent chemicals therein.

In order to accommodate the cleaning functions the foregoing typical circulation arrangement has been modified to connect to a clean-out system generally designated by the numeral 10. More specifically, and by way of example referring to the developing tank, the circulation loop $L_d$ is modified to include two tee connections $\mathbf{11}_d$ and $\mathbf{12}_d$ on either side of a one direction check valve $\mathbf{13}_d$. These tee connections then connect to two corresponding check valves $\mathbf{15}_d$ and $\mathbf{16}_d$ which, in turn, connect to quick disconnects $\mathbf{17}_d$ and $\mathbf{18}_d$. Thus the only modification necessary to the prior art developing tank $C_d$ is the inclusion of tees $\mathbf{11}_d$ and $\mathbf{12}_d$ on either side of a one direction check valve $\mathbf{13}_d$. These tee connections then connect to two corresponding check valves $\mathbf{15}_d$ and $\mathbf{16}_d$ which, in turn, connect to quick disconnects $\mathbf{17}_d$ and $\mathbf{18}_d$. Thus the only modification necessary to the prior art developing tank $C_d$ is the inclusion of tees $\mathbf{11}_d$ and $\mathbf{12}_d$ and the check valves disposed therebetween together with the corresponding quick disconnects. Once this modification has been made the above-mentioned clean out system may then be plugged in, on a shared basis, between various film processing stations.

More specifically tee $\mathbf{12}_d$ and the check valve $\mathbf{16}_d$ communicate from the output of the circulating pump $P_d$ to the quick disconnect $\mathbf{18}_d$. The quick disconnect in turn connects one end of a solenoid actuated valve $\mathbf{21}_d$ which at its output connects across a tee $\mathbf{22}_d$ to the input of a further pump $\mathbf{23}_d$ and yet another valve $\mathbf{24}_d$. The other end of valve $\mathbf{24}_d$ connects to the bottom of a holding tank $\mathbf{25}_d$ which also connects across a valve $\mathbf{26}_d$ and a tee $\mathbf{27}_d$ to the output of the pump $\mathbf{23}_d$. Tee $\mathbf{27}_d$ connects to yet another valve $\mathbf{28}_d$ which, in turn, across a check valve $\mathbf{29}_d$ and a tee $\mathbf{31}_d$ connect or completes the loop to the other quick disconnect $\mathbf{17}_d$. Thus by valves $\mathbf{21}_d$, $\mathbf{24}_d$, $\mathbf{26}_d$ and $\mathbf{28}_d$ various circulation arrangements can be formed, one including the path to fill or drain the holding tank $\mathbf{25}_d$ while the other forming a loop across the two quick disconnects. The foregoing loop may be further augmented by way of a connection to a tee $\mathbf{31}_d$ to provide for the injection of cleaning fluids.

More specifically tee $31_d$ ties to yet another tee $32_d$ which connects both to the output of a check valve $33_d$ and one port of a two-way selector valve $34_d$. Looped between one of the ports of valve $34_d$ and the input of check valve $33_d$ is a cleaning fluid holding tank $35_d$, the remaining port of the selector valve being tied by way of yet another valve $36_d$ to a pressure regulating unit $37_d$ connected to a source of clean water.

Thus according to the selection of the valve position $34_d$ and the state of valve $36_d$ either fresh cleaning water is provided to clean out the tank $C_d$ or a predetermined volume of cleaning fluid stored in container $35_d$ is injected. In addition a drain path may be provided from a tee 39*d* disposed between valve 23*d* and tee 27*d* which branches off to a drain valve 38*d* to any conventional sewage trap S.

The foregoing valving arrangement therefore provides the necessary selection features for storing the developing or fixing fluid, injection water into the developing tank, circulating that water with a concurrent injection of cleaning fluid, which may then be drained and the stored developing fluid may then be returned back to the developing tank. The fixing tank designated by the subscript f is similarly augmented by a parallel fixing loop including the same valving arrangement connected thereto. For brevity reference should be had to the subscript notation illustrated in FIG. 1, the two valving arrangements being distinguishable by the subscript "d" and "f" for the developer and fixer circuits.

Figure 2:
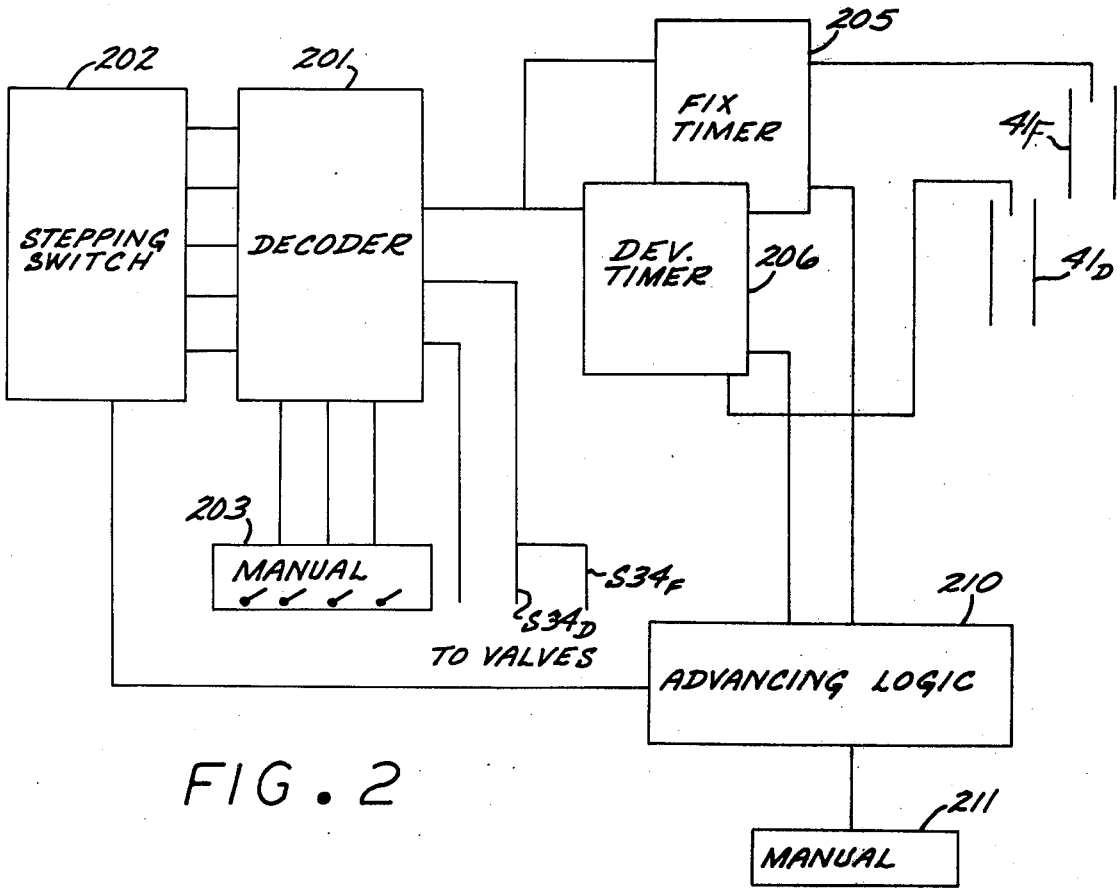
FIG. 2 is a block diagram of a logic stage useful in controlling the piping diagrams shown in FIG. 1.

To control the fluid amounts during the various cycles this rendered possible the developer and fixer tanks are further modified to include level detectors $41_d$ and $41_f$ which may be utilized to indicate the volume of developing or fixing fluid collected therein. It is to be understood that each of the above-mentioned valves is a solenoid actuated valve and fully automatic path selection is therefore possible. As shown in FIG. 2 the signals to the above-mentioned valves $34_d$, $26_d$, $28_d$, et cetera, are developed at the output of a decoder 201, the signals being identified by the signal leads prefixed by "S" with the suffix corresponding to the valve articulated. Thus, for example, decoder 201 provides a signal $S34_d$ which is branched off to also articulate the corresponding fixer path shown as a branch signal $S34_f$. The input to decoder 201 originates at a stepping switch assembly 202 which provides the various signal outputs of a stepping switch the position thereof code being fanned out to the necessary valving in order to complete a particular loop. The mode of fan-out is similarly controlled by way of a manual input shown herein as a manual switch bank 203 which, according to the description following, may either suppress or expand portions of the fan-out or in fact modify the type of fan-out to accommodate the various circulation modes available in the valve arrangement.

Decoder 201 also provides two timer signals, one to a fixer timer 205 and another to a developer timer 206. Timers 205 and 206 also combine the level indication signals from level sensors $41_f$ and $41_d$ and thus will be disabled to synchronize the cycle at those instances where fill or drain levels are required.

In this manner the variations and flow rate inherent in any piping system will be periodically augmented to synchronize both tanks. The timing outputs of timers 206 and 205 are applied to an advancing logic stage 210 which also receives a manual override signal from a manual control panel 211 wherein manual intervention, e.g., removal and installation of filters into the developing system is accommodated. Upon a proper combination of signals from timers 205 and 206 and the manual intervention signal from the manual switch 211 the advancing logic 210 will then produce a stepping signal to advance the switch assembly 202 to the next step controlling another decoder fan-out to the above-mentioned valves.

It is to be understood that the foregoing logic description may be implemented in various ways. For example, the arrangement of a stepping switch may be either mechanical or solid state, the decoder itself may take on various configurations, and the advancing logic stage may be similarly variously implemented. While it is possible to implement the foregoing system in various ways, one specific implementation is set out in the description following, particularly by reference to the description entailing FIG. 4.

Figure 3:
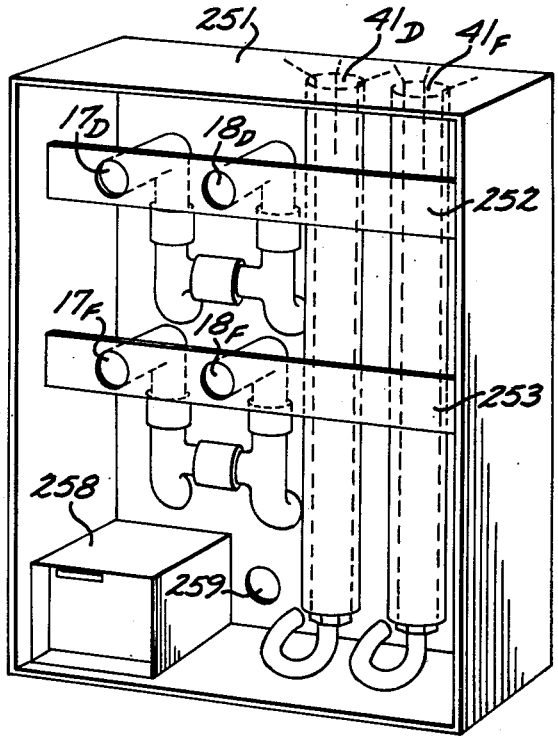
FIG. 3 is a perspective view of an interface stage useful with the invention herein.

The foregoing system and valves to accommodate the aforementioned prior art units may be contained in a packaged unit connected through an interface panel shown in FIG. 3. More specifically, as shown in FIG. 3 the interface panel comprises a rectangular housing 251 provided with the aforementioned quick disconnects $17_d$ and $17_f$ and $18_d$ and $18_f$ mounted on a developer and fixer strap shown herein as straps 252 and 253. Connected to the straps and extending from the aforementioned quick disconnects are the check valves previously described and in particular check valves $13_d$, $13_f$ and $16_d$, $16_f$ and $15_d$, $15_f$. It is these check valves that establish the flow direction in and out of the developer and fixer tanks and accommodate the various clean-out modes described above.

At the same time the check valves are connected to the above-mentioned tees through the back wall of housing 251, housing 251 further including the above-mentioned level sensors $41_d$ and $41_f$. Also included in housing 251 is a power panel 258 to which connection may be made by the portable cleaning systems. Where the draining of the fluids can be made into a waste line the interfaced panel also includes a drain outlet 259 which commonly collects both the fixer and developer tank to the drain S.

To conserve cost it is contemplated to adapt the prior art developers and fixers with the interface panel set out in FIG. 3 and then to utilize a single clean-out system 10 to perform periodic cleaning. Thus, for example the commercially available processors such as Kodak M6-AN or a Jameison 35 MM processor may be conveniently adapted for automated clean-out. Each includes the necessary circulation loops and reference should therefore be had to the piping arrangement provided by the manufacturer.

Figure 4:
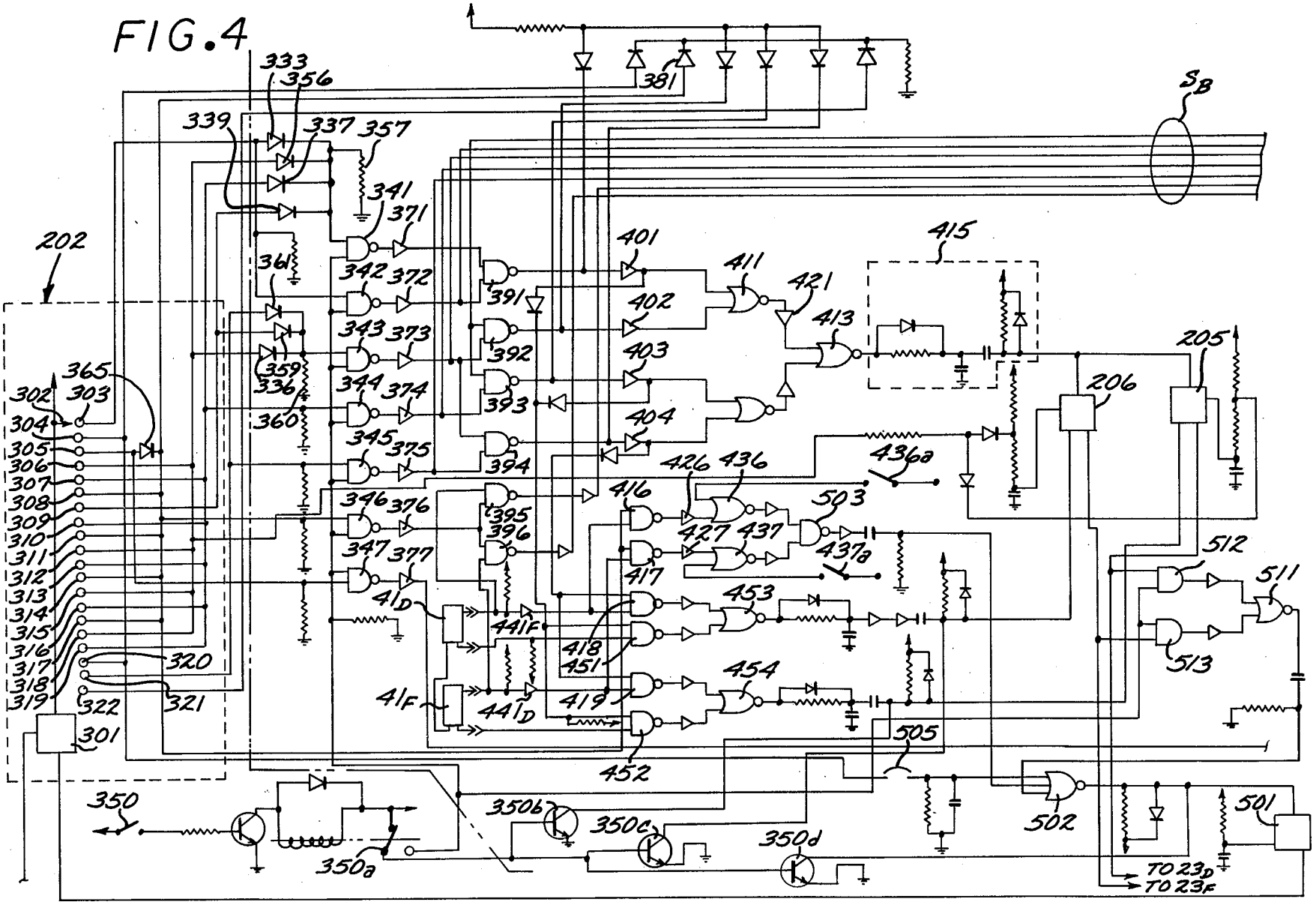
FIG. 4 is a circuit diagram useful with the invention herein.

With the foregoing description of the system a particular implementation of the logic shown in FIG. 2 will now be taken up. More specifically, as shown in FIG. 4 the stepping switch 202 is assembled by way of a mechanical stepper 301 tied to a contact 302 which translated in sequence across a plurality of terminals 303 through 323. Thus as stepper 301 is advanced to the successive step positions terminals 303 through 323 are excited. Terminal 303, through a diode 333 is connected to one input of a NAND gate 341 which at its other input receives a start-stop signal from a switch 350 initiating or stopping the automatic operation of the clean-out system described herein. Switch 350 is in series with a relay switch 350*a* which articulates between a timer enable and disable state. At the same time terminal 303 is also fanned out to a NAND gate 342 which, again, receives the start-stop signal at the other input. The next successive NAND gate 343 similarly receiving the start-stop signal, also receives the signal out of terminal 307 across a diode 336. Terminal 306 is also connected to the input of gate 341 once more across a diode 356 arranged in a logical or with diode 333 by way of a resistor to ground 357. Similarly terminal 307 across the diode 337 is ored at the input of gate 341 together with the output of terminal 309. Terminal 339 across the diode 359 is ored with the diode 336 in a manner similar to that described above. Thus gates 343 and 341 have an OR combination at the input thereof, gate 343 also also receiving as the third part of the or across the diode 361 the signal developed at terminal 322. In addition, the signal from terminal 307 is combined with the on-off signal at the input of a NAND gate 344 while the signal from terminal 322 is also combined with the on-off signal at a NAND gate 345. A further NAND gate 346 collects the signal from terminal 308, terminal 308 being shorted to terminal 311, 314 and 317. A further NAND gate 347 combines the on-off signal with the output of terminal 305, this same terminal being connected through a diode 365 to the terminals 308, 311, 314 and 317. Thus, the common connection at the output of diode 365 exhibits the signals at any of the abovereferenced terminals 305, 308, 311, 314 and 317, terminal 305 being isolated on its path to gate 347 from this combination. The combined signal on any of the foregoing terminals is connected to the annode of a light emitting diode 381 indicating a fill process in the course of the clean-out sequence. Accordingly, a repetitive function like fill will occur several times in the course of the completion of one cycle each time providing a visual indication thereof.

Each of the foregoing NAND gates 341-347, in turn, is fed to a corresponding inverter 371 to 377, the outputs of inverters 371 and 372 being in turn collected in a further NAND gate 391 while the output of inverters 371 and 373 is collected in a NAND gate 392. This same output of inverter 371 is also collected with the inverters 374 at a NAND gate 393 while a NAND gate 394 collects inverters 373 and 375. Inverter 376 is set in common to one input of two NAND gates 395 and 396 the other input to NAND gate 395 being the level detector output of level detector **41*d*. Gate 396, at the other input, in turn receives the level output of level detector 41*f***.

The outputs of gate 391 and 392 are inverted through corresponding inverters 401 and 402 to the inputs of a NOR gate 411 once more inverted at the output thereof by inverter 421. NAND gates 393 and 394, similarly inverted through inverters 403 and 404 are collected at the input of a NOR gate 412 which is inverted at the output through an inverter 422. Inverters 421 and 422 are then collected in yet another NOR gate 413 which through an RC network collectively shown as network 415 provides the set inputs to the developer and fixer timers 206 and 205. Level detectors **41*f* and 41*d* also connect across corresponding inverters 441*f* and 441*d* to the inputs of two respective NAND gates 416 and 417 which, through corresponding inverters 426 and 427 provides the respective one inputs to two NOR gates 436 and 437 which receive at their other inputs the positive signal across two corresponding manual switches 436*a* and 437*a*. The other input to NAND gates 416 and 417 is the collected alternative input of terminals 305, 308, 311, 314 and 317. At the same time the output of inverters 441*f* and 441*d* are respectively applied to NAND gates 418 and 419 which at the other inputs thereof receive the output of the inverter 404. At the same time the level sensing contact of level detectors 41*d* and 41*f* are respectively collected at the inputs of two corresponding NAND gates 451 and 452 which at their other inputs receive the output of inverter 403. Gates 418 and 451, inverted, are collected at the input of a NOR gate 453 while gates 419 and 452, inverted, are collected at a NOR gate 454. NOR gate 453 through an RC network, provide the reset input to the developer timer 206. NOR gate 454, once more through the appropriate RC components, provides the reset output to the fixer timer 205. In this manner the two level detectors are interlaced to provide a reset to the timers at a point where both level detectors are satisfied. The timers are then ready to receive the next set inputs from the abovementioned NOR gate 413 and will thus provide the necessary output signal to pump 23*d* and 23*f*. At the same time the common outputs of terminals 306, 312, 315 and 318 provide the excitation for the timing terminals of developer timer 206 and fixer timer 205 in selecting steps of the stepping switch advance. Thus, during the selected portions of the cycle where fluids are provided to the developer and fixer tanks until a predetermined level is reached the recess signals inhibit the timers, bringing the system back into synchronization between the fixer and developer loops. The advancement of the stepping switch is controlled by a step driver 501 set by the output of a NOR gate 502 which at one of its inputs receives the inverted output of a NAND gate 503 collecting at the input thereof the inverted output of NOR gates 436 and 437. The alternative input to NOR gate 502 may be a manual switch 505 enabled by terminals 321 and 322 as an example, switch 505** requiring manipulation at the point in the sequence where the normal line filters found in the processing tanks have to be either removed or installed.

It is to be understood that the installation of a filter quite frequently depends on the mode of operation of the clean-out system. More specifically during parts of the cycle when the new fluids are inserted the retention of an old filter in the line may unnecessarily contaminate these freshly added fluids. Alternatively, the filter may have to be in line when the fluids are circulated for use, both or some of the other requisite manipulations of the filter occurring in siclic fashion as the clean-out process progresses. Gate 502 further receives the output of yet another NOR gate 511 which collects at the input thereof the inverted outputs of two NAND gates 512 and 513 arranged as a latching circuit on the output signals of timers 205 and 206. It is the output of the step driver 501 that advances the stepping switch 301 to complete the cycle and the timers 205 and 206 each include an associated tune out circuit setting the developer and fixer intervals.

By way of the foregoing description the necessary signals enabling the various valves, shown herein by way of a single brand $S_b$ originate in the decoder stage 201 including the aforementioned NAND gate 341 through 327. The same NAND gate also provides the necessary signals to the advancing stage 210 which, according to the combinations of gates 411, 421 through 511, operates the step driver 501 to complete the cycle. During the course of this sequence the occurrence of periodic switch positions will call for manual intervention such as, for example, the articulation of switch 505. It is this manual intervention that has been heretofore set out as the manual terminal 311, it being understood that additional functions may be implemented thereby. In each instance the signal branch $S_b$ develops the necessary valve signals to provide the appropriate fluid routing and it is only in those instances where manual intervention with the cycle is necessary that manual switch action is brought in.

In addition the select signal leads in a signal branch $S_b$ may be brought out to light emitting diodes as that shown by example diode 381 to indicate by way of a lighting bank the status of the cycle.

Obviously many modifications and changes may be made to the foregoing description without departing from the spirit of the invention. It is therefore intended that the scope of the invention be determined solely on the claims appended hereto.

What is claimed is:

1. In a film processor including a developer and fixer container the improvement comprising:

an automated clean-out system adapted to be connected to the circulation loops around said developer and fixer containers of a film processor, including;

a first and second check valve respectively installed in said loops around said developer and fixer containers;

quick disconnect means installed directly in said loops adjacent said first and second check valves;

first and second conduit means respectively connected to said quick disconnects each said conduit means including a corresponding pump and valving means for selecting the direction of flow therethrough;

a first and second level detector respectively connected to said developer and fixer containers for sensing the level of liquids therein; and automated sequencing means connected to said valving means, said pump and said first and second level detectors, said sequencing means including a first and second timer for advancing the selection of the direction of flow upon the occurrence of preselected time intervals.

2. Apparatus according to claim 1 wherein said sequencing means includes logic means connected between said first and second level detectors and said first and second timers for disabling said first timer when said second sensor is registering a liquid level below a selected depth.

3. Apparatus according to claim 2 wherein: said first and second conduit means each includes a storage tank selectively connected for draining liquids into said conduit means or for accumulating liquids from said conduit means by said valving means.

4. Apparatus according to claim 3 wherein:

said sequencing means includes a stepping switch having a plurality of terminals selectable in sequence upon the receipt of a stepping signal, and a decoder connected to said terminals of said stepping switch for producing a combination of parallel electrical signal codes having electrical signal combinations corresponding to each one of said terminals.

5. Apparatus according to claim 4 wherein:

selected ones of said terminals are connected together.

6. Apparatus according to claim 5 wherein:

said first and second timers each includes generating means for producing said stepping signal; and said logic means includes selector means responsive to the position of said stepping switch for selecting said stepping signal from said first or second timer.

7. Apparatus according to claim 6 wherein:

said sequencing means includes manual input means for altering the advancement thereof according to manual input.

* * * * *